United States Patent [19]

Gatlin et al.

[11] 3,973,635

[45] Aug. 10, 1976

[54] METHOD AND APPARATUS FOR OFFSHORE DRILLING OPERATIONS

[75] Inventors: John M. Gatlin, San Antonio; J. P. Pittman, Houston, both of Tex.

[73] Assignee: Exxon Production Research Company, Houston, Tex.

[22] Filed: Dec. 2, 1974

[21] Appl. No.: 528,764

[52] U.S. Cl. ..... 175/7; 166/.5
[51] Int. Cl.[2] ..... E21B 7/12
[58] Field of Search ..... 175/7; 166/.5

[56] References Cited

UNITED STATES PATENTS

| | | | |
|---|---|---|---|
| 2,917,281 | 12/1959 | Kofahl | 175/7 |
| 2,929,610 | 3/1960 | Stratton | 175/7 X |
| 3,159,218 | 12/1964 | Wilde | 175/7 X |
| 3,292,694 | 12/1966 | Lacy et al. | 166/.5 X |
| 3,426,844 | 2/1969 | McDaniel | 166/.5 |
| 3,519,071 | 7/1970 | Word | 175/7 |

*Primary Examiner*—Ernest R. Purser
*Assistant Examiner*—Richard E. Favreau
*Attorney, Agent, or Firm*—John S. Schneider

[57] ABSTRACT

A one-step method and apparatus for placement of a drilling guide base, running tool, and drill string during offshore drilling operations. The running tool is retrievable from the guide base leaving the drill string in position to commence drilling operations without having to return the drill string to the surface for removal of the running tool.

17 Claims, 10 Drawing Figures

10
11
12
13
14
14A
15
16
17
18
19
20
21
22
23
24
25
26
4
7

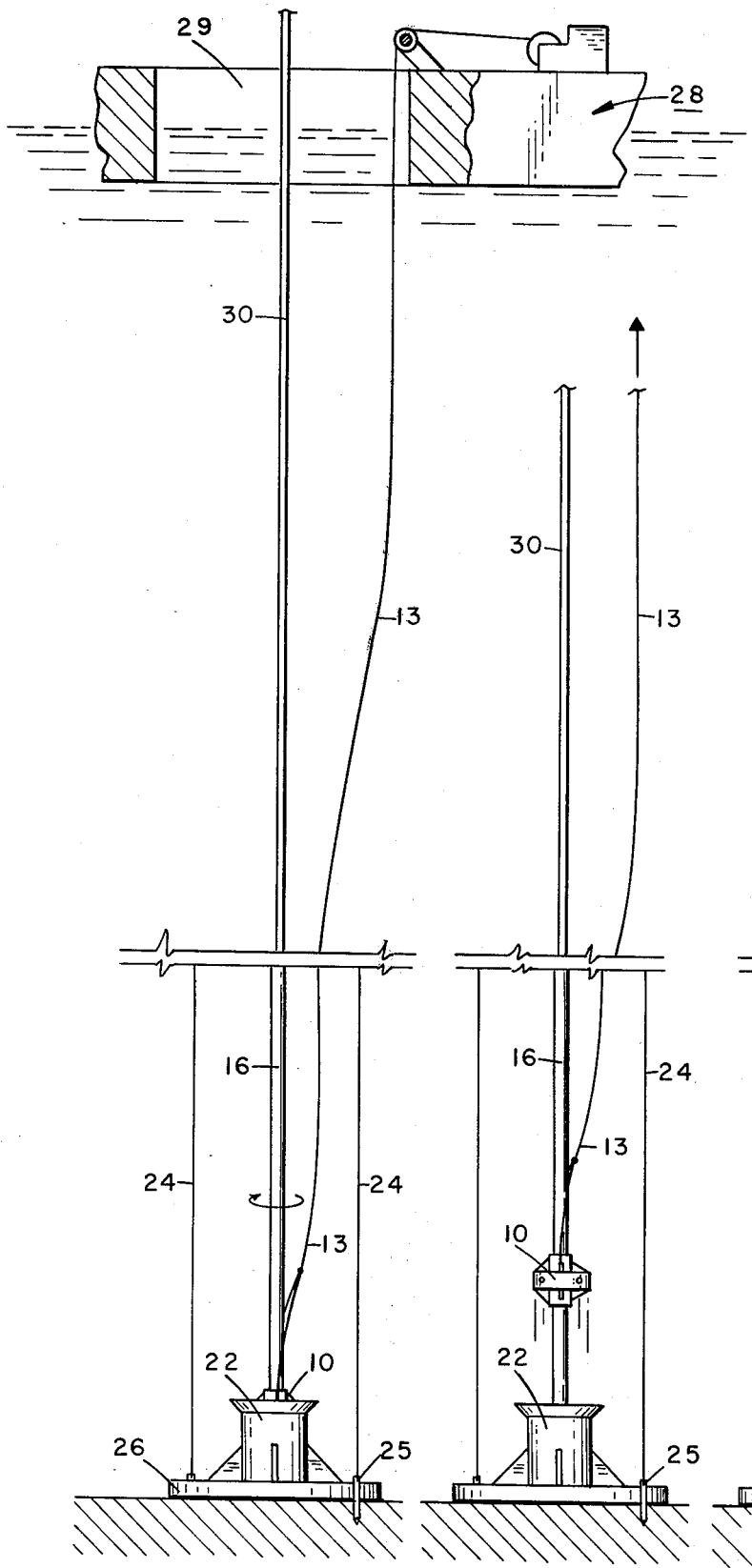
FIG. 8.
FIG. 9
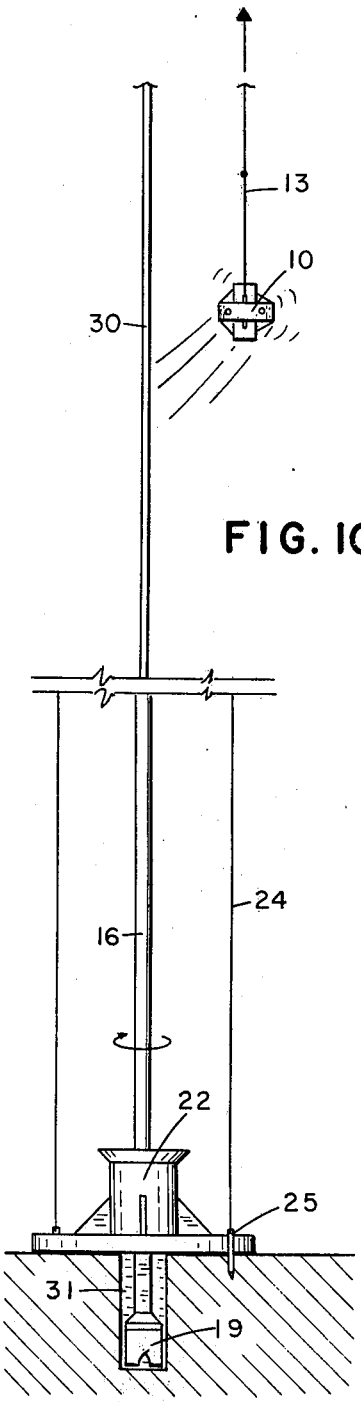
FIG. 10.

METHOD AND APPARATUS FOR OFFSHORE DRILLING OPERATIONS

BACKGROUND OF THE INVENTION

In offshore drilling operations from a floating drilling vessel, it is necessary to initiate drilling by placing a temporary guide base structure on the ocean floor. The temporary guide base permits proper positioning of a drill string for initial drilling operations. Thereafter, a permanent guide base structure is added to the temporary guide base structure and is built up therefrom. Prior to commencing drilling operations, it has been required heretofore to place the temporary guide base on the ocean floor by attaching it to a drill string and a running tool and lowering the temporary guide base with the drill string and running tool by continually attaching additional sections of drill pipe to the drill string until the entire apparatus reaches the ocean floor. In that operation the function of the running tool is to facilitate the connection of the temporary guide base and drill string and to insure proper positioning of the guide base on the drilling site. Thereafter the drill string and running tool are released from the temporary guide base and returned to the drilling vessel by continually removing drill pipe sections until the entire drill string has been removed and the running tool is returned to the surface. Retrieving the entire drill string is required to remove the running tool from the bottom of the drill string as it is impossible to drill with the running tool in place. Once the running tool is removed and the drill bit is attached to the drill string, the drill string is returned, along guide lines, to the temporary guide base by continually adding sections of drill pipe until the drill string is properly placed within the temporary guide base on the ocean floor. Only at this point can drilling operations be commenced.

In summary, to begin drilling operations three main steps were required. Basically, these steps were lowering the temporary guide base, running tool, and drill string, section by section, to the drilling site; returning the drill string and running tool to the vessel, section be section; removing the running tool and placing the drill bit on the drill string; and returning the drill string to the ocean floor section by section. This complete process requires a great deal of time and is therefore very expensive.

BRIEF SUMMARY OF THE INVENTION

This invention relates to a method and apparatus used during offshore drilling operations. Such operations might be conducted from a floating vessel, a drilling platform or other offshore structures.

More specifically, this invention relates to method and apparatus for one-step placement of the guide base and drill string on the ocean floor in proper position. The invention provides a means for releasing a running tool from the temporary guide base and drill string, and retrieving the running tool without having to disengage the drill string from the guide base. This permits spudding a hole immediately without having to trip the drill string back to the vessel thus eliminating one complete round trip of disassembling and reassembling the drill string.

Therefore, it is a principal object of the invention to provide a method and means for improved offshore drilling operations.

A further object of this invention is to provide a method and means for one-step placement of a temporary guide base and drill string.

A further object of this invention is to provide a releasable running tool which can be retrieved independently of a temporary guide base and drill string.

BRIEF DESCRIPTION OF THE DRAWINGS

So that the features, advantages and objects of the present invention, as well as others, which will become apparent, can be understood in detail, a more particular description of the invention, briefly summarized above, may be had by reference to the embodiment thereof which is illustrated in the appended drawings. It is to be noted, however, that the appended drawings illustrate only a typical embodiment of the invention and are therefore not to be considered limiting of its scope, for the invention may admit to other equally effective embodiments. In the drawings:

FIG. 8 is a pictorial representation of a side elevation of the temporary guide base with inserted drill string resting on the ocean floor and its relationship to a drilling vessel.

FIG. 9 is the side elevation of FIG. 8 illustrating the retrieval of the running tool from the temporary guide base leaving the drill string and bit in place.

FIG. 10 illustrates the disengagement of the running tool from the narrower sections of the upper drill string and commencement of the drilling operations.

DESCRIPTION OF THE PREFERRED EMBODIMENTS

Figures 1, 2, 3, 4, 5, 6, 7:
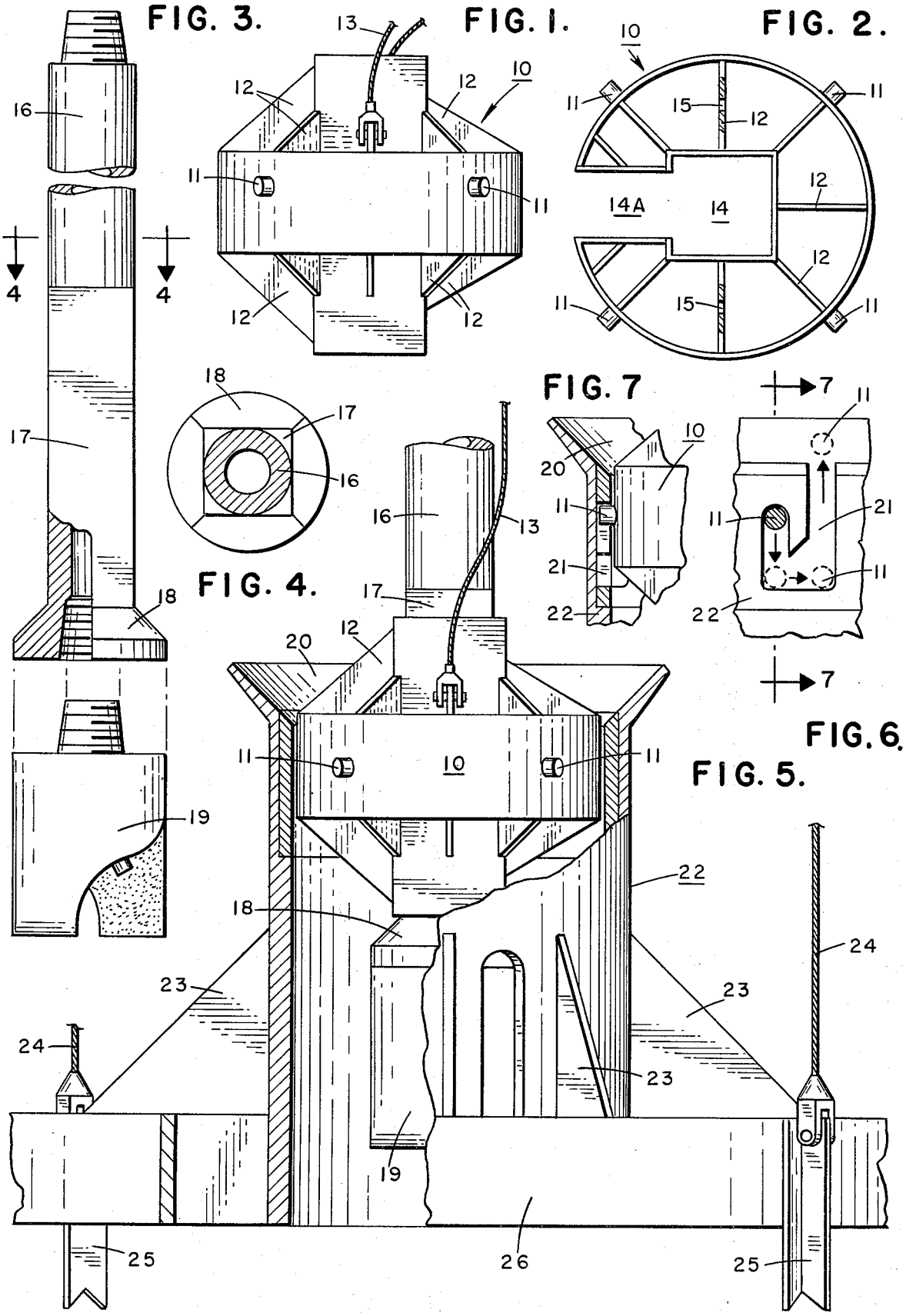
FIG. 1 is a pictorial representation of a side elevation of a running tool, showing placement of retrieval lines and lugs.
FIG. 2 is a top view of the running tool of FIG. 1 showing the internal arrangement of an inner sleeve for placement of the running tool around a drill string section.
FIG. 3 is a pictorial representation of a side elevation of a typical drill string showing, in sections, an upper drill string section, a drill collar sub having an enlarged rectangular portion and a flared collar at its lower end, and its engagement with a drill bit.
FIG. 4 is a cross-sectional view taken along line 4—4 of FIG. 3.
FIG. 5 is a pictorial representation of a side elevation, partly in section, of a temporary drilling guide base showing arrangement of the running tool as it is engaged with the drill string and attached to the temporary guide base.
FIG. 6 is a fragmentary view, partly in section, of FIG. 5 showing the engagement of the lugs of the running tool with exemplary "J-slots" of the temporary guide base.
FIg. 7 is a fragmentary view, partly in section, of FIG. 6 taken along line 7—7.

Now referring to the drawings, and first to FIG. 1, a running tool 10 is shown as a rim-like structure having lugs 11 disposed about its outer periphery. The running tool can be of varied design, for example, rectangular or square, hollow or solid. Further, the lugs can also be shear pins, snap prongs, or the like. Cross support members 12 are arranged in spoke-like fashion and connect the outer rim with the inner sleeve 14 of FIG. 2. Inner sleeve 14 has a narrower section 14A which opens to the exterior of the running tool. A retrieval cable 13 is arranged in bridle-like fashion and is attached to cross support members 12 at clevis eyelets 15, for returning the running tool to the surface. Referring now to FIG. 3 a drill collar sub 16 is shown having an enlarged rectangular section 17 thereof which serves as a wrench when engaged within the inner sleeve 14 of running tool 10. A flared collar 18 is shown at the lower end of drill collar sub 16 which serves as a stop for running tool 10 and also for attaching drill bit 19 to the drill string. The drill collar sub 16 is attached to upper sections of drill pipe not shown. Referring now to FIG. 4, the relationship of flared flange 18 with rectangular wrench 17 and cylindrical drill collar sub 16 is shown.

FIG. 5 shows the arrangement of the running tool 10 with drill collar sub 16 as the running tool 10 is engaged with rectangular wrench section 17 resting upon flared collar 18 with attached drill bit 19. Also shown is the arrangement of the running tool 10 and drill collar sub 16 with the temporary guide base 22. The temporary guide base is defined by a base plate 26 with attached toe spikes 25. Running from the toe spikes 25 are guide lines 24 which extend to the surface and are attached to the drill ship. Support members 23 are arranged about the guide sleeve 22 of the temporary guide base and are attached to base plate 26. At the uppermost end of guide sleeve 22 is a flared seat 20. The upper interior of guide sleeve 22 includes J-shaped lug slots 21 for engagement with lugs 11 of running tool 10. The J-shaped lug slots can also be shear pin ports or the like.

FIG. 6 is a fragmentary view of a J-slot 21 showing the positioning of a lug 11 and the manner in which the lugs are disengaged from the J-slots 21 of guide sleeve 22.

FIG. 7 shows a lug 11 of running tool 10 engaged into a J-shaped lug slot 21 within guide sleeve 22.

Referring now to FIG. 8 a drill ship 28 is shown with drill string 30 extending downwardly through moon pool 29 of a drill ship 28. Temporary guide base 22 is shown resting on the ocean floor with toe spikes 25 embedded in the ocean floor. Guide lines 24 extend upwardly to the drill ship. The drill string is shown as it rotates to free the running tool. FIG. 9 shows the running tool as it is being retrieved along the drill string 30.

FIG. 10 shows the disengagement of running tool 10 from drill string 30 and retrieval of running tool 10. Finally FIG. 10 shows the commencement of drilling operations with drill bit 19 spudding well bore 31.

OPERATION

Once the drill vessel is positioned in the desired location, the running tool is inserted over the drill collar sub and positioned so that the inner sleeve 14 of the running tool is in close engagement with the wrench portion 17 of the drill collar sub and rests on flange 18. The drill bit is fitted in position at the bottom of the drill collar sub. The running tool and drill shaft are now inserted into the temporary guide base and the lugs lock the running tool into position. The temporary guide base is now lowered from the vessel by the drill string and running tool guide lines to the ocean floor adding drill pipe to the drill string, section by section, until the temporary guide base is firmly anchored on the ocean floor (FIG. 8). The running tool, which is attached to the temporary guide base by the engagement of the lug with the J-slots, is now lowered several inches so that the lugs are resting at the bottom of the J-slots (FIG. 6). The drill string is then partially rotated so that the lugs are free to be lifted from the J-slots. At this point the running tool is retrieved by a winch on the drill ship which retrieves cable 13 thus pulling the running tool upwards along the drill string (FIG. 9). The taper (reduced diameter) of the drill string (larger drill collar to smaller drill pipe) facilitates disengagement of the running tool, and when the running tool reaches a point along the drill string where the drill string is narrow enough in diameter, the running tool slips free of the string allowing its independent return to the surface. The drill string remains in place centered in the temporary guide base. Once the running tool is disengaged from the drill string drilling operations can commence (FIG. 10). Thus, the necessity of returning the drill string section by section to the drill ship, and then removing the running tool, attaching the drill bit to the drill shaft, and "tripping" the drill shaft back down to the temporary guide base, section by section, is avoided.

It is therefore seen that this invention is one well adapted to obtain all of the objects and advantages, hereinabove set forth, together with other advantages, which will become obvious from the description of the method and apparatus. It will be understood that certain combinations and subcombinations are of utility and may be employed without reference to other features and subcombinations. This is contemplated by and is within the scope of the present invention.

As many possible embodiments may be made of this invention without departing from the spirit and scope thereof, it is to be understood that all matters hereinabove set forth or shown in the accompanying drawings, are to be interpreted as illustrative and not in any way limiting and not in an otherwise limiting sense.

What is claimed is:

1. An apparatus for use in offshore drilling operations, comprising:

a. a drill string;

b. a guide base for receiving said drill string;

c. tool means for running said guide base to the ocean floor on said drill string, said tool means being supportable on and movable along said drill string and including means for releasably engaging said guide base; and d. means for moving said tool means upwardly along said drill string.

2. An apparatus for use in offshore drilling operations, comprising:

a. a guide base having a plurality of lug slots disposed about the interior thereof;

b. a base plate having a plurality of toe spikes;

c. a plurality of guide lines extending upward from said base plate and attached thereto;

d. a retrievable running tool engageable with said guide base, having a plurality of lugs disposed about the outer periphery thereof; and e. a drill string having a reduced diameter upper portion and a lower drill collar sub attached thereto, said sub being of such size as permits insertion through said running tool.

3. An apparatus according to claim 2 wherein said guide base has a funnel-shaped seat forming an opening at the top of said guide base.

4. An apparatus according to claim 2 wherein said base plate is secured to said guide base by a plurality of angular reinforcing members disposed about said guide base and affixed to said base plate.

5. An apparatus according to claim 2 wherein the interior of said running tool is defined by a rectangularly shaped sleeve, an outer rim and a plurality of support members connecting said sleeve and outer rim, said sleeve and said rim being provided with an opening to the exterior of said running tool.

6. An apparatus according to claim 2 wherein said drill collar sub is generally cylindrically shaped, said sub also having a rectangularly shaped portion; said running tool including a rectangularly shaped inner sleeve arranged in close relation with the rectangularly shaped portion of said sub, said sub having a flared collar at its lower end.

7. A method of performing offshore drilling operations, comprising the steps of:

a. supporting a running tool on a drill string;
b. inserting said drill string with said running tool supported thereon into a guide base and engaging said running tool and guide base;
c. lowering said drill string, running tool and guide base to a desired drilling location on the ocean floor;
d. disengaging said running tool from said guide base; and thereafter
e. disengaging said running tool from said drill string and retrieving said running tool by pulling said running tool upwards along said drill string.

8. A method of performing offshore drilling operations, comprising the steps of:

a. supporting a running tool on a drill string;
b. inserting said drill string with said running tool supported thereon into a guide base;
c. lowering said drill string, running tool and guide base to a desired drilling location on the ocean floor;
d. anchoring the guide base to the ocean floor;
e. disengaging said running tool from said guide base;
f. retrieving said running tool along said drill string; and thereafter
g. disengaging said running tool rom said drill string and retrieving said running tool by pulling said running tool upwards along said drill string.

9. The method of claim 8 in which the step of supporting said running tool on said drill string includes:

a. slipping said running tool having a rectangularly shaped inner sleeve over said drill string,
b. positionng said running tool in close relation with a rectangularly shaped section of said drill string, and
c. resting said running tool upon a flared collar at the lower end of said drill string.

10. The method of claim 8 in which the step of anchoring said guide base to the ocean floor includes stabbing a plurality of toe spikes, attached to said guide base, into the ocean floor.

11. The method of claim 8 in which the step of disengaging said running tool from said drill string includes:

a. raising said running tool along said drill string to a point where said drill string is narrower than an opening in an inner sleeve of said running tool, and
b. slipping said running tool off said drill string thereby freeing said drill string to commence drilling operations.

12. The method of claim 8 in which the step of inserting said drill string with said running tool supported thereon into a guide base includes:

a. attaching said running tool to said guide base by inserting a plurality of lugs disposed about said running tool into corresponding J-shaped lug slots disposed about the interior of said guide base, and
b. hanging said guide base on said running tool.

13. The method of claim 12 in which the step of disengaging said running tool from said guide base includes:

a. lowering said running tool to lower said lugs of said running tool in said lug slots of said guide base,
b. rotating said running tool to free said lugs, and
c. lifting said running tool from said guide base.

14. The method of claim 12 in which the step of retrieving said running tool from said guide base includes retrieving a cable attached to said running tool leaving said drill string in place within said guide base.

15. An apparatus for use in offshore drilling operations comprising:

a. a drill string having an upper drill pipe section and a lower drill collar section larger than said drill pipe section, said drill collar section having a rectangularly shaped portion thereof and an enlarged part larger than the remainder of said drill collar section;
b. a guide base to be located on an ocean floor, said guide base including a cylindrical guide sleeve, a base plate surrounding said guide sleeve, support members arranged on said guide sleeve and attached to said base plate, toe spikes connected to said base plate, and J-slots formed in said guide sleeve;
c. a running tool movable along said drill string and supportable on said enlarged part of said drill collar section and connectable to said guide base, said running tool having a generally rectangularly shaped sleeve slightly larger than said rectangularly shaped portion of said drill collar section and fitting onto said rectangularly shaped drill collar section such that rotation of said drill string rotates said running tool;
e. said running tool containing an outer rim connected to said sleeve, said outer rim containing lugs engageable with said J-slots in said guide base;
e. said sleeve of said running tool and said outer rim of said running tool forming an opening larger than said upper drill pipe section.

16. An apparatus for use in offshore drilling operations comprising:

a. a drill stringn comprising an upper section, a lower drill collar section larger than said upper section and an enlarged part below said drill collar section, said drill collar section having a generally rectangularly shaped portion above said enlarged part of said drill string;
b. a running tool to be located on an ocean floor movable along said drill string and supportable on the enlarged part of said drill string, said running tool having a rectangularly shaped sleeve designed to fit said rectangularly shaped portion of said drill collar section in a manner such that rotation of said drill string rotates said running tool;
c. a guide base to be lowered to the ocean floor;
d. means on said guide base and on said running tool cooperating to releasably connect said running tool and guide base for lowering said guide base on said running tool and drill string to said ocean floor.

17. An apparatus for use in offshore drilling operations comprising:

a. a drill string comprising an upper section and a lower larger section, said lower section having an enlarged part thereof;
b. a guide base to be located on an ocean floor;

c. a running tool movable along said drill string and releasably connectable to said guide base, said running tool being supportable on said enlarged part of said drill string;

d. means for moving said running tool upwardly along said drill string;

e. means on said drill string and said running tool cooperating to cause rotation of said running tool upon rotation of said drill string; and f. means on said running tool and said guide base cooperating to releasably connect said running tool and guide base.

* * * * *